US006346016B1

(12) United States Patent
Aoyama et al.

(10) Patent No.: US 6,346,016 B1
(45) Date of Patent: Feb. 12, 2002

(54) CHAINED TERMINALS AND METHOD FOR FORMING SUCH CHAINED TERMINALS

(75) Inventors: Masahiko Aoyama; Masashi Saito; Takashi Koide, all of Yokkaichi (JP)

(73) Assignee: Sumitomo Wiring Systems, Ltd. (JP)

( * ) Notice: Subject to any disclaimer, the term of this patent is extended or adjusted under 35 U.S.C. 154(b) by 0 days.

(21) Appl. No.: 09/447,113

(22) Filed: Nov. 22, 1999

(30) Foreign Application Priority Data

Nov. 24, 1998 (JP) ..... 10-332910

(51) Int. Cl.[7] ..... H01R 9/24
(52) U.S. Cl. ..... 439/885
(58) Field of Search ..... 439/885; 206/717

(56) References Cited

U.S. PATENT DOCUMENTS 4,685,212 A 8/1987 Masuda et al.
5,242,570 A 9/1993 Roodnat
5,782,644 A 7/1998 Kiat
5,938,039 A * 8/1999 Liu ..... 439/885

FOREIGN PATENT DOCUMENTS

DE 44 19 293 4/1995
JP 5-8894 2/1993

* cited by examiner

*Primary Examiner*—Neil Abrams
(74) *Attorney, Agent, or Firm*—Anthony J. Casella; Gerald E. Hespos

(57) ABSTRACT

Chained terminals (10) are formed such that a multitude of terminal fitting pieces (12) are connected in parallel with a lateral edge of a carrier (11) in the form of a long strip, and are wound around and dispensed from a reel (20) with an interlayer sheet (21) laid underneath. Each terminal fitting piece (12) is formed with projections (17) projecting in a direction normal to a radial direction of the reel (20), i.e. a direction along the plane of the interlayer sheet (21). Thus, the projections (17) neither stick into the interlayer sheet (21) nor are deformed by being caught in by the interlayer sheet (21). Protecting portions (19) are aligned with the projections (17) but extend further from the carrier (11) for protecting the projections (17).

7 Claims, 9 Drawing Sheets

CHAINED TERMINALS AND METHOD FOR FORMING SUCH CHAINED TERMINALS

BACKGROUND OF THE INVENTION

1. Field of the Invention

The present invention relates to chained terminals and to a method for forming or producing such chained terminals.

2. Description of the Related Art

Terminal fittings are produced from a long metal plate that is stamped out by a press such that a multitude of terminal fitting pieces project from a lateral edge of a narrow carrier. The terminal fitting pieces are bent to have a form specified for the terminal fittings, thereby obtaining chained terminals. The chained terminals are wound around a reel and transported to sites for separating the terminal fittings from the carrier and connecting the terminal fittings to a printed circuit board. A prior art construction for winding the chained terminals around a reel is disclosed in Japanese Unexamined Utility Model Publication No. 5-8894 and other publications.

A long strip of interlayer sheet is applied to radially inner surfaces of the prior art chained terminals when the chained terminals are wound around the reel. Thus the chained terminals are wound around the reel together with the interlayer sheet. The interlayer sheet prevents the chained terminals from touching the chained terminals located in the adjacent wound layer and prevents them from being scratched, entangled and damaged due to their mutual interference.

FIG. 9 shows one piece of prior art chained terminals "a" to be connected to a printed circuit board. The prior art chained terminals "a" include a plurality of terminal fitting pieces, one of which is shown in FIG. 9 and is identified as "b". The terminal fitting piece "b" includes connection portions "c" in the form of pins that project outwardly. The terminal fitting piece "b" (terminal fitting), when separated from its carrier "d", is mounted on a printed circuit board (not shown) by inserting the connection portions "c" into through holes of the printed circuit board and soldering them. The chained terminals "a" also are wound around a reel "f" together with an interlayer sheet "e" during transportation, and are dispensed from the reel "f" together with the interlayer sheet "e" at a transportation end.

The prior art chained terminals "a" are wound as shown in FIGS. 7 and 8, such that the connection portions "c" project radially outwardly, and such that the projecting ends of the connection portions "c" of the terminal fitting pieces "b" are in contact with the interlayer sheet "e" at a radially outer side. The interlayer sheet "e" is made hard to tear by, for example, selecting a suitable material therefor or applying a surface treatment. However, if a tension acting on the chained terminals "a" increases during the winding, or if the reel having the chained terminals wound therearound is subjected to large vibration during transportation, the leading ends of the connection portions "c" at the radially inner side may stick into the interlayer sheet "c" at the radially outer side. If the chained terminals "a" are dispensed from the reel "f" with the connection portions "c" stuck into the interlayer sheet "e", the stuck portion of the interlayer sheet "e" catches the connection portions "c" when departing from the reel "f". At this time, the interlayer sheet "e" may deform the caught connection portions "c" since the interlayer sheet is hard to tear.

An easy-tear interlayer sheet may be considered to prevent the deformation of the connection portions "c". However, an easy-tear interlayer sheet "e" cannot fulfill its original function of avoiding a direct contact of the chained terminals "a". Conversely, it may be considered to increase a tear strength by thickening the interlayer sheet "e". However, since the interlayer sheet "e" is made of paper, it is difficult to prevent it from being torn by the metal connection portions "c". An improvement in the tear strength of the interlayer sheet "e" by applying surface treatment or changing a material is not desirable since it results in an increased cost.

In view of the above problems, an object of the present invention is to provide chained terminals and a method for producing the chained terminals that allows for an improved operability, in particularly preventing projections of terminal fitting pieces from being caught in by an interlayer sheet and defined.

SUMMARY OF THE INVENTION

According to the invention, there are provided a chained terminal array with a multitude of terminal fitting pieces connected with or extending from a lateral edge of a long carrier preferably a strip or plate. The terminal fitting pieces each have connection projections that project therefrom for connecting the terminal fitting pieces to an external device. The terminal fitting pieces are connected with the carrier in such an orientation that the connection projections thereof project in directions substantially parallel to or substantially lying in the plane of the carrier.

Accordingly, the connection projections do not extend away from the plane of the carrier, thereby reducing the likelihood of interference of the connection projection with outside parts, such as a layer of terminals placed on the upper or lower part thereof or such as an interlayer sheet arranged thereon.

According to the invention, there is further provided a chained terminal array with a multitude of terminal fitting pieces connected with or extending from a lateral edge of a carrier. The carrier preferably is in the form of a long strip or plate, and is formed with one or more protecting portions that project from the carrier in a direction at an angle different from 0° and 180°, and preferably substantially normal to the carrier. A projecting distance of the protecting portions in a direction normal to the plane of the carrier is substantially larger than a projecting distance of the corresponding or adjacent terminal fitting piece. Accordingly, the protecting portions can be held in contact with an interlayer sheet e.g. on the radially outer side. Thus the projecting portions enable intervals between the respective layers of the chained terminals to be larger than the radially outwardly projecting distance of the terminal fitting pieces, thereby preventing the terminal fitting pieces from contacting the interlayer sheet laid adjacent thereto.

Preferably, distal ends of the protecting portions are bent so that the protecting portions substantially have an L-shaped cross section.

Most preferably, the chained terminals are wound or windable around and dispensed or dispensable from a reel with an interlayer sheet laid between adjacent layers of the chained terminals. The terminal fitting pieces are connected with the carrier such that the connection projections thereof project in directions substantially normal to radial directions of the reel.

According to a further preferred embodiment of the invention, there are provided chained terminals which are constructed such that a multitude of terminal fitting pieces are parallel to one another and extend from a lateral edge of a long carrier strip. The chained terminals are wound around and dispensed from a reel with an interlayer sheet between adjacent layers of the chained terminals. The terminal fitting pieces are formed with projections that project normal to radial directions of the reel.

With the chained terminals wound around the reel, the interlayer sheet is laid between the terminal fitting pieces in a radially inner layer and those in the radially outer layer. Since the projections of the terminal fitting pieces project in directions normal to the radial directions of the reel, i.e. directions substantially along the plane of the interlayer sheet, the projections do not stick into the interlayer sheet. Accordingly, there is no likelihood that the projections are deformed by being caught in the interlayer sheet when the chained terminals are dispensed from the reel.

Preferably, the carrier is formed with one or more protecting portions. The protecting portions are dimensioned to contact the interlayer sheet when the chained terminals are wound around the reel, thereby keeping the interlayer sheet and the terminal fitting pieces substantially separated from each other. Thus the projection portions contact the interlayer sheet as the interlayer sheet is separating from the terminal fitting pieces of the chained terminals that are being dispensed from the reel.

With the chained terminals wound around the reel, the protecting portions project in radial directions while being in contact with the interlayer sheet. Accordingly, the radial intervals of the respective layers of the chained terminals is held at a predetermined distance or longer. This keeps the terminal fitting pieces and the interlayer sheet, which depart from each other when the chained terminals are dispensed, separated from each other, and therefore securely prevents the projections from sticking into the interlayer sheet.

Most preferably, the terminal fitting piece is connected to the carrier via a covering portion that is configured to substantially cover or close an opening of the terminal fitting piece after its separation from the carrier.

According to the invention, there is further provided a method for forming or producing chained terminals according to the invention. The method comprises stamping a metal plate for forming a plurality of planar terminal fitting pieces projecting from a lateral side of a long carrier. The method continues by bending the terminal fitting pieces to form connection projections that projecting therefrom for connecting the terminal fitting pieces to an external device. The bending step is carried out such that the terminal fitting pieces are arranged with respect to the carrier in such an orientation that the connection projections project in directions substantially parallel to or substantially lying in a plane of the carrier.

According to the invention, there is further provided a method for forming chained terminals, comprising stamping a metal plate for forming a plurality of substantially planar terminal fittings that project from a carrier, in particular from the lateral side of a long strip or a plate. The method continues by bending the terminal fitting pieces, and providing the carrier with one or more protecting portions that project therefrom in a direction at an angle different from 0° and 180°, preferably substantially normal to the carrier. A projecting distance of the protecting portions in a direction normal to the plane of the carrier is substantially larger than a projecting distance of the corresponding or adjacent terminal fitting piece.

Preferably, the method further comprises the step of winding the chained terminals around a reel with an interlayer sheet laid between adjacent layers of the chained terminals. Additionally the terminal fitting pieces are bent from the carrier in such an orientation that the connection projections of the terminal fitting pieces project substantially normal to radial directions of the reel.

The invention further relates to a chained terminal assembly, in which chained terminals according to the invention are wound on a reel with one or more interlayer sheets arranged or laid between adjacent layers of the chained terminals.

These and other objects, features and advantages of the present invention will become more apparent upon a reading of the following detailed description and accompanying drawings.

DETAILED DESCRIPTION OF THE PREFERRED EMBODIMENT

Figure 1:
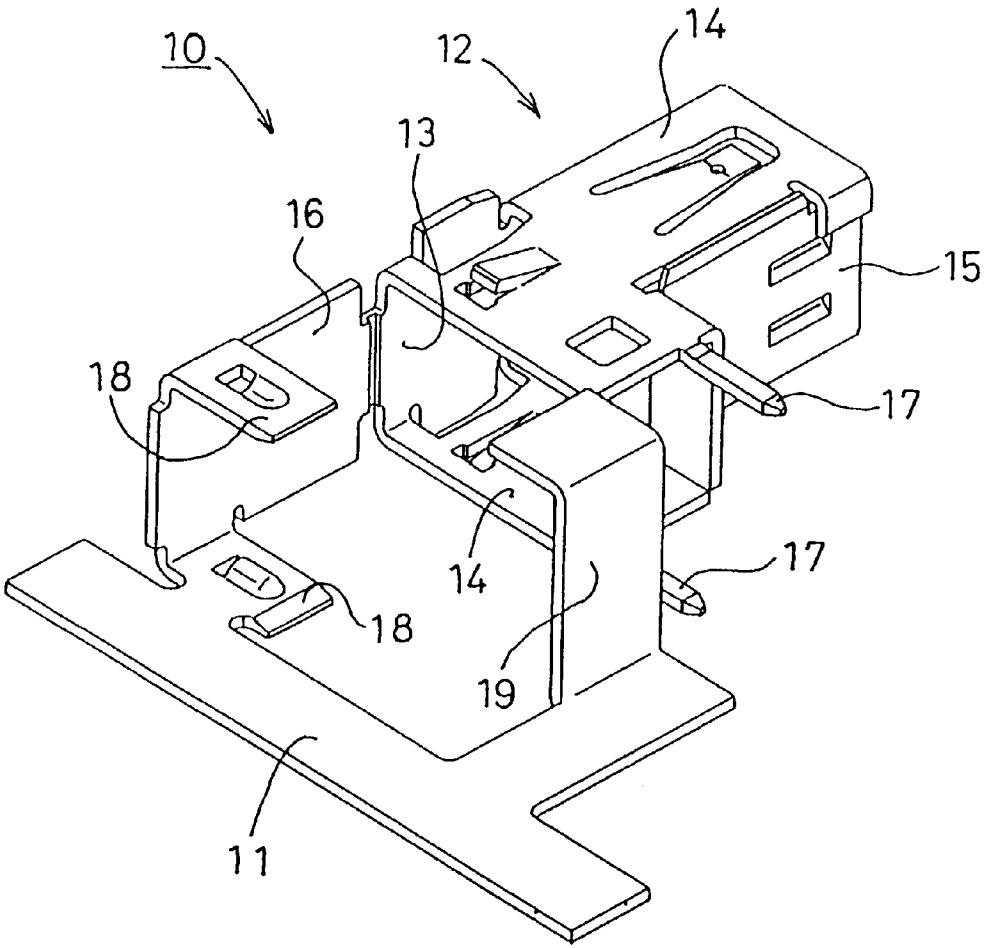
FIG. 1 is a perspective view showing a part of chained terminals according to one embodiment.
Figure 5:
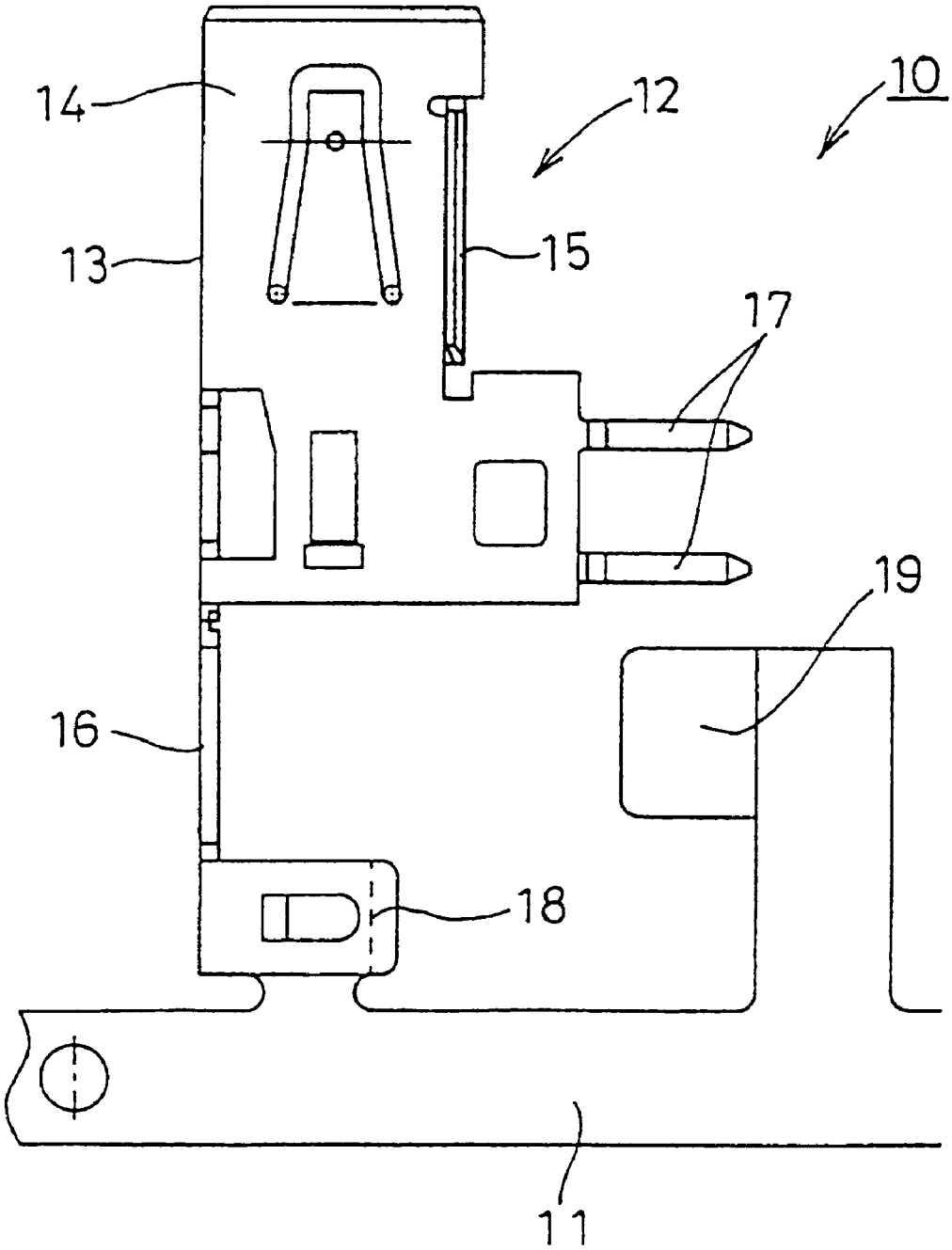
FIG. 5 is a plan view partially showing the chained terminals.
Figure 6:
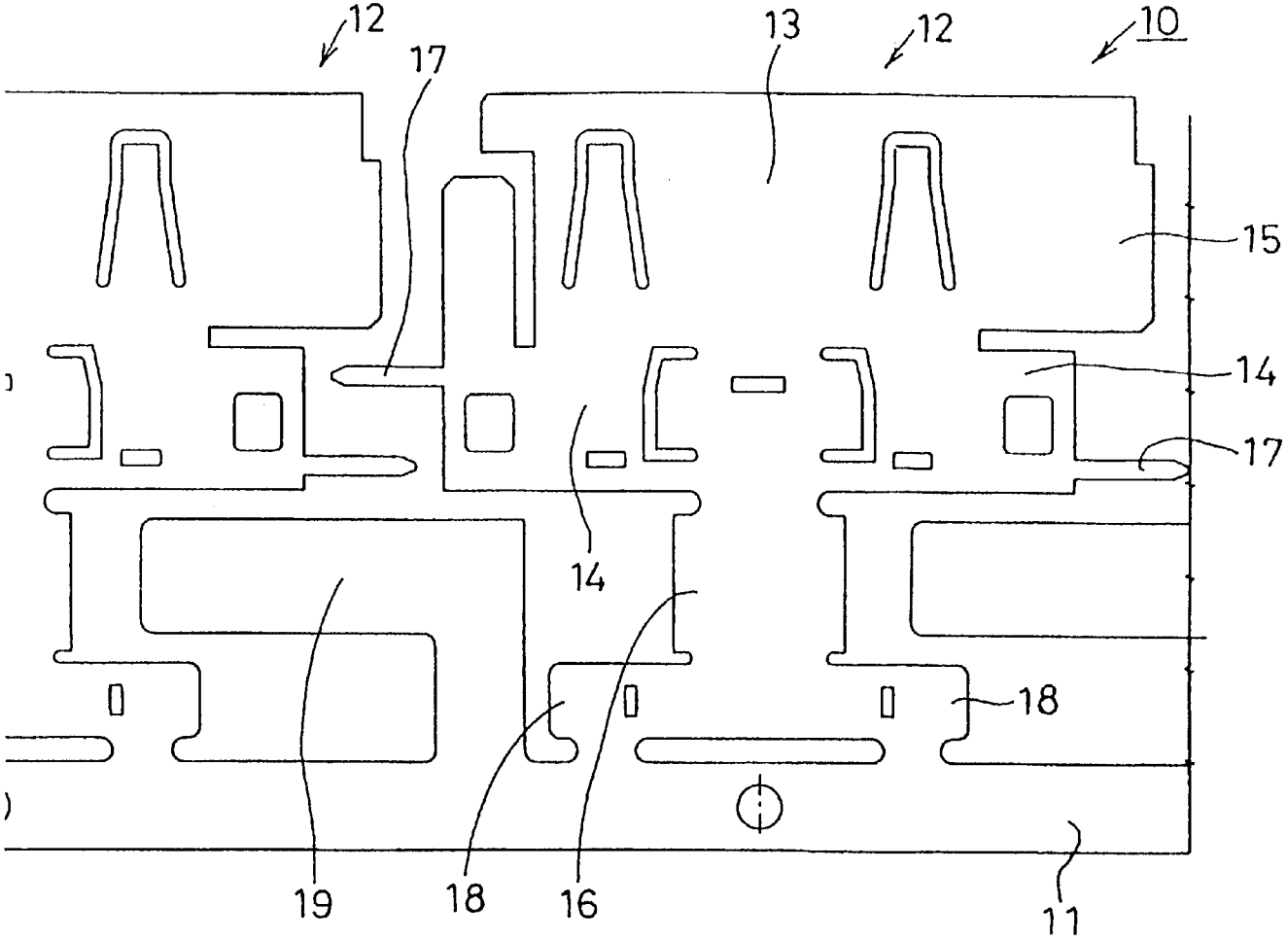
FIG. 6 is a plan view showing a development of the terminal fitting pieces of the chain terminals.
Figure 7:
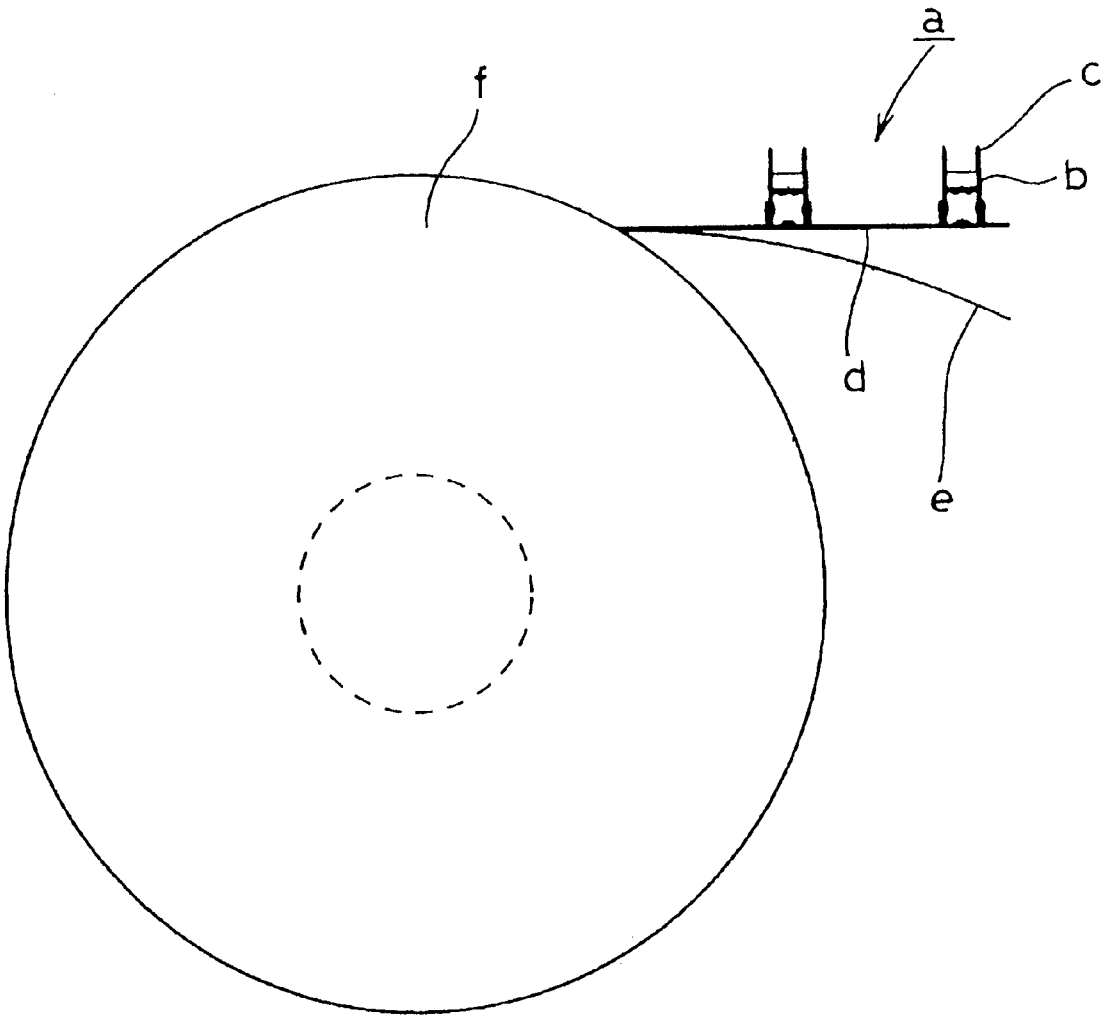
FIG. 7 PRIOR ART
FIG. 7 is a side view showing a state where chained terminals are wound around or dispensed from a reel in prior art.
Figure 8:
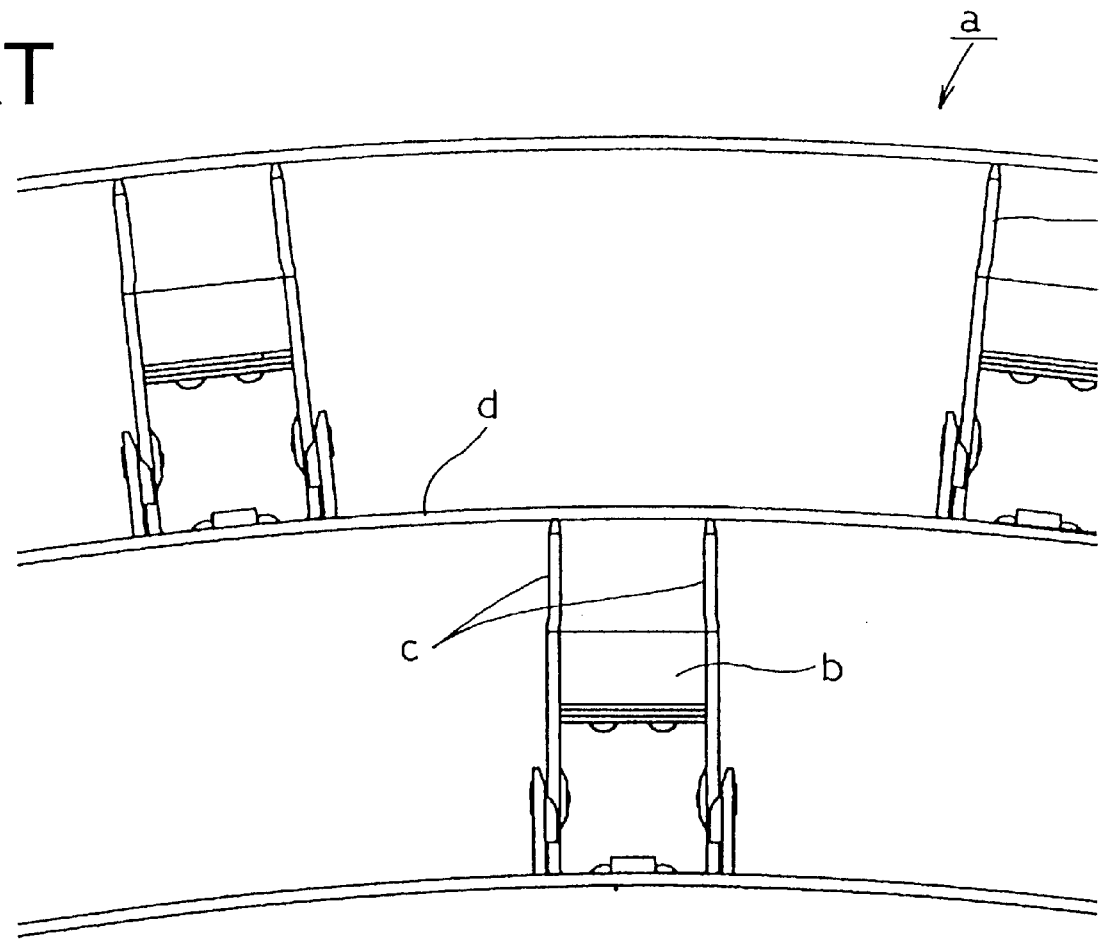
FIG. 8 PRIOR ART
FIG. 8 is a partial enlarged side view showing the chained terminals wound around the reel.
Figure 9:
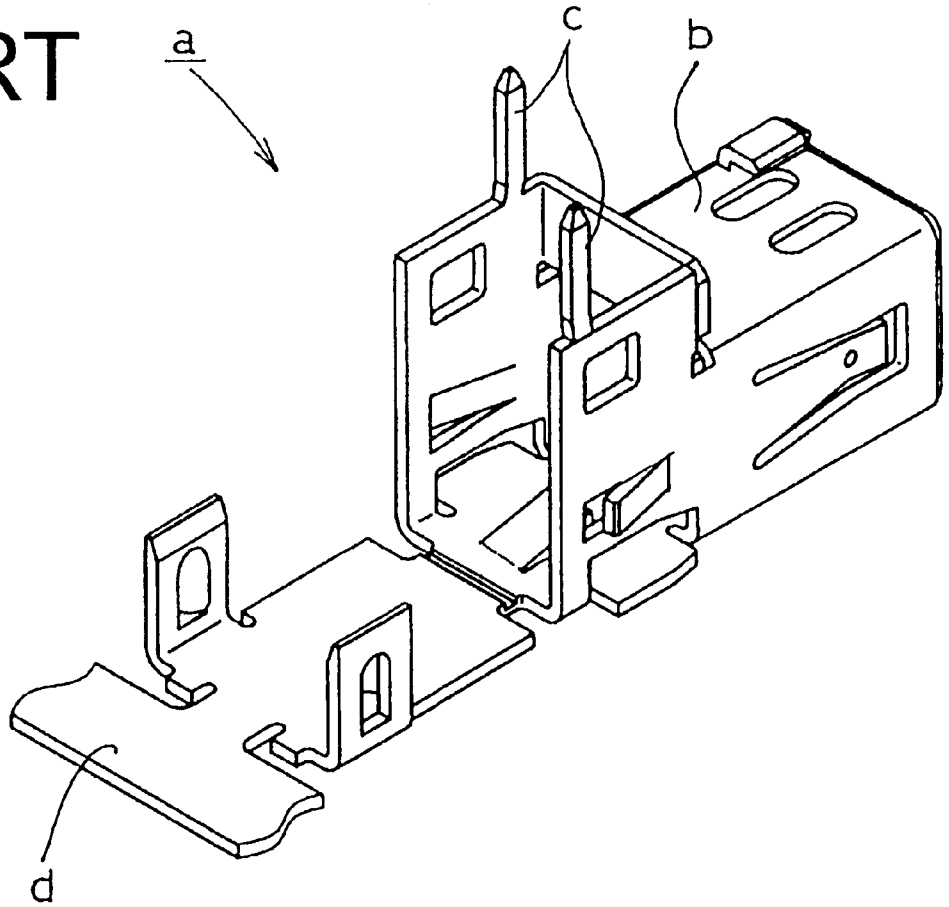
FIG. 9 PRIOR ART
FIG. 9 is a perspective view partially showing the chained terminals of prior art.

Chained terminals according to this embodiment are identified by the numeral 10 in FIGS. 1–6. The chained terminals 10 are produced from a strip of metal plate that is stamped out by a press to form a multitude of planar terminal fitting pieces 12. The terminal fitting pieces 12 cantilever from a lateral edge of a long carrier strip 11 and are substantially flush with the carrier 11 (see FIG. 6). Next, the planar terminal fitting pieces 12 are bent to have a form specified for the chained terminals 10 as shown in FIGS. 1 and 5. The chained terminals 10 are wound around a reel 10 and transported to operation sites for an operation of separating the terminal fitting pieces 12 from the carrier 11 and for an operation of connecting the separated terminal fitting pieces 12 to printed circuit boards. When the chained terminals 10 are wound around the reel 20, a long strip of interlayer sheet 21 is applied to radially inner surfaces of the chained terminals 10. Thus the chained terminals 10 are wound around the reel 20 while being laid on the interlayer sheet 21. The interlayer sheet 21 prevents the chained terminals 10 from being brought into direct contact with those of an adjacent layer and prevents scratches and other damage by the mutual interference of the chained terminals 10. When the chained terminals 10 are dispensed from the reel 20, the interlayer sheet 21 applied to the radially inner surfaces thereof is dispensed simultaneously (see FIG. 3).

Figure 2:
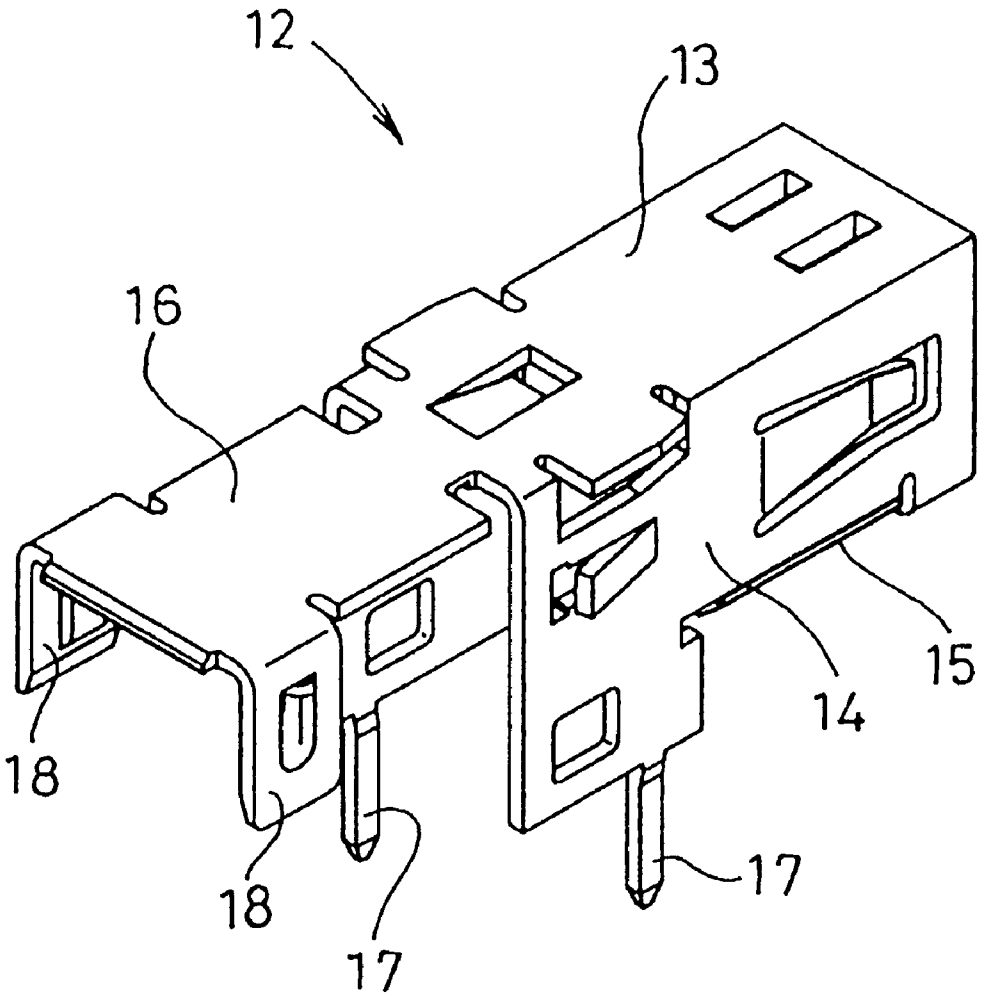
FIG. 2 is a perspective view of a terminal fitting piece separated from a carrier.
Figure 3:
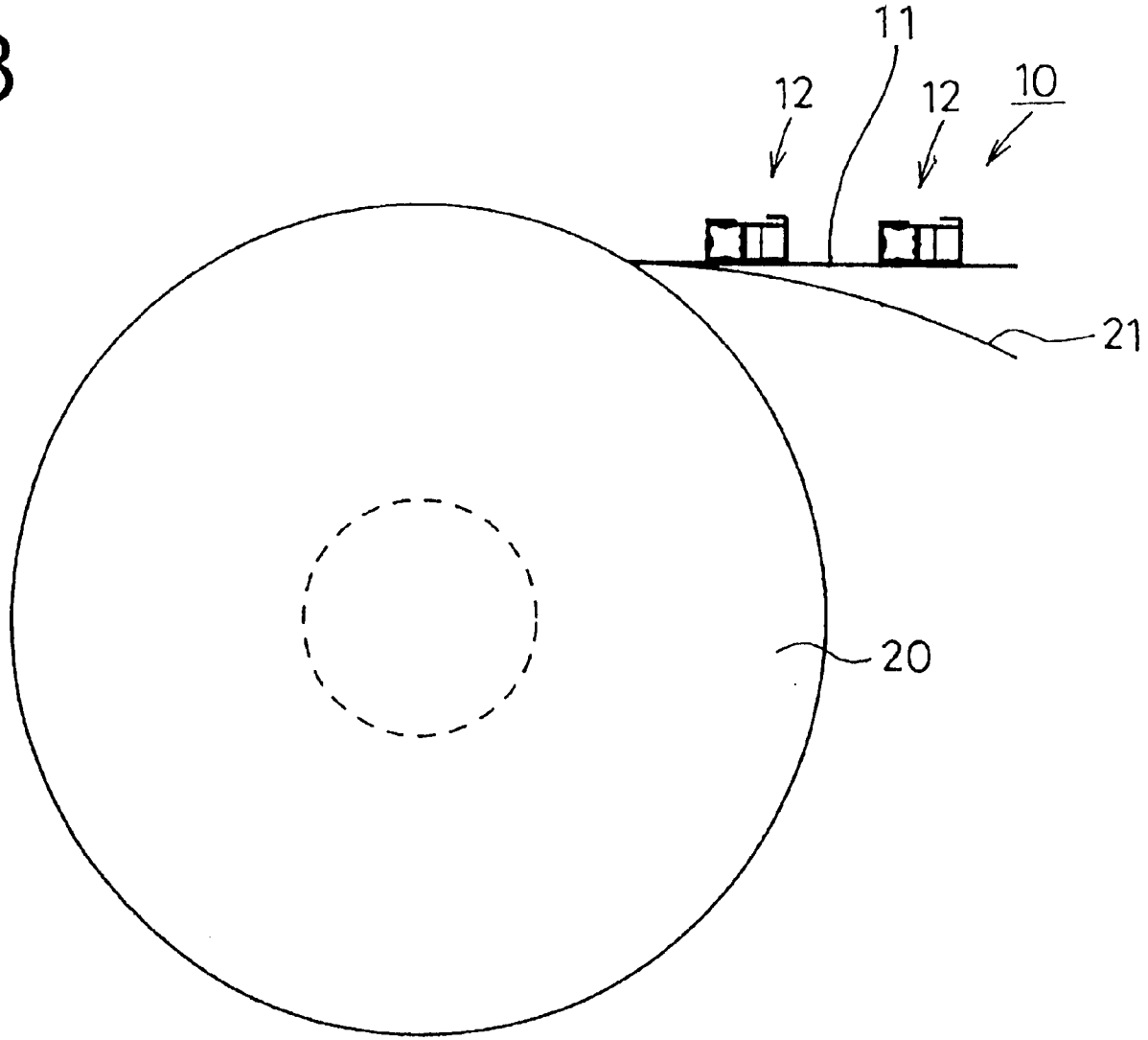
FIG. 3 is a side view showing a state where the chained terminals are wound around or dispensed from a reel.
Figure 4:
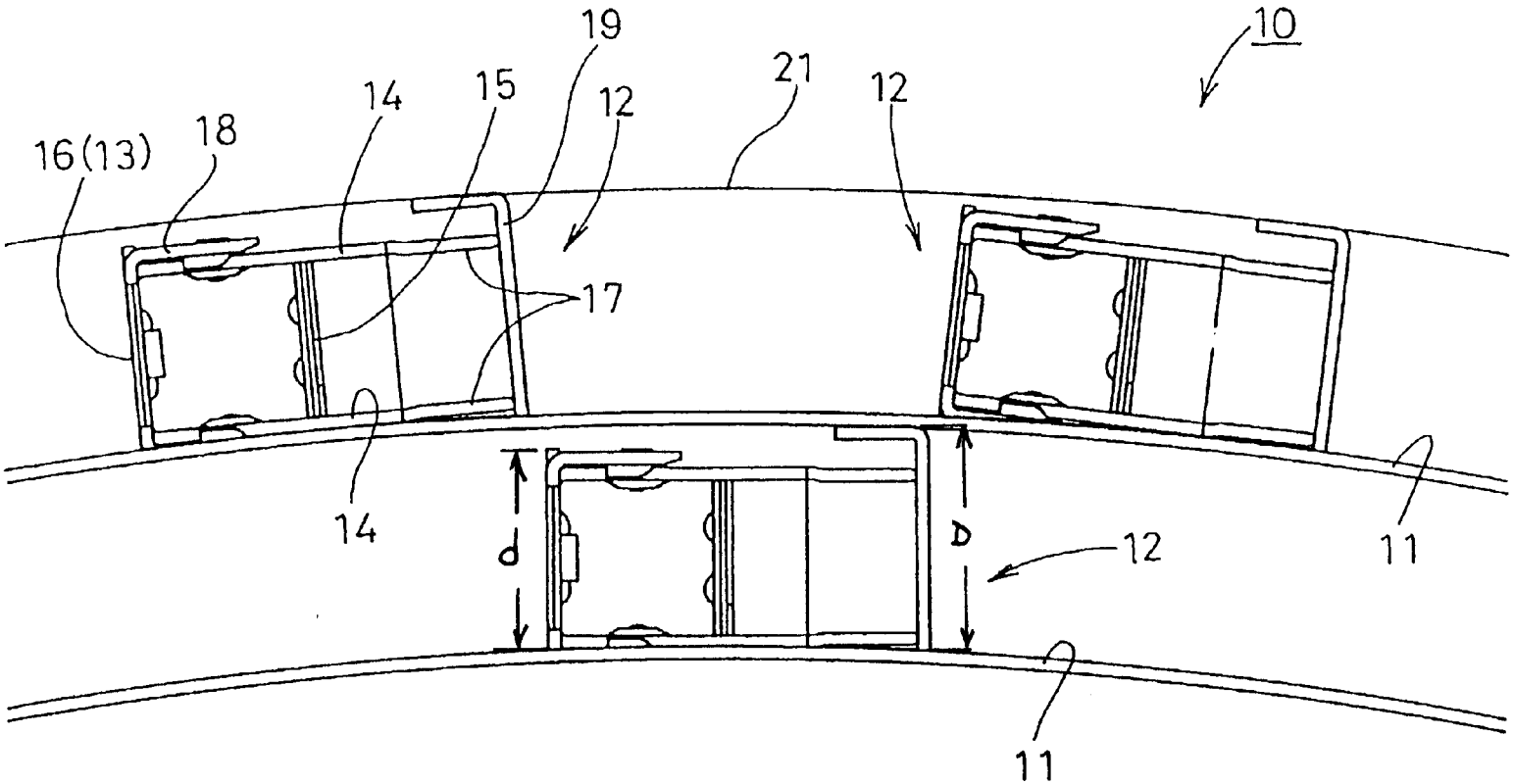
FIG. 4 is a partial enlarged side view showing the chained terminals wound around the reel.

The terminal fitting piece 12 is connectable to an unillustrated external device, such as a printed circuit board, after being separated from the carrier 11 (see FIG. 2). The terminal fitting piece 12 is, as a whole, shaped such that substantially L-shaped side plates 14 extend substantially downwardly from lateral or left and right side edges of a top plate 13. A bottom plate 15 extends from the bottom edge of one side plate 14, and a cover plate 16 extends from the rear edge of the top plate 13 substantially flush with the top plate 13. The cover plate 16 is bent downwardly at a boundary line with the top plate 13 and is assembled to substantially close a rear opening of a space enclosed by the top plate 13 and the side plates 14. The cover plate 16 is held assembled by engaging locking portions 18 extending from the left and right edges of the cover plate 16 with the side plates 14.

Each of the left and right side plates 14 is formed with a projection 17 that preferably is in the form of a narrow pin projecting downwardly from the bottom edge of the side plate 14. The projection 17 of the right side plate 14 is located at the front and that of the left side plate 14 is located at the back. The projections 17 are electrically and/or mechanically connectable to the external device, such as an electric or electronic equipment, e.g. a printed circuit board, an electric connection box, a connector or the like, preferably by being inserted or insertable into through holes (not shown) of the external device, e.g. the printed circuit board and secured by soldering or the like connection means. In this way, the terminal fitting piece 12 is electrically conductively mounted on the printed circuit board.

The terminal fitting piece 12 is connected with the carrier 11 via the left locking portion 18 of the cover plate 16. This locking portion 18 is substantially flush with the carrier 11, and the cover plate 16 is bent upwardly preferably at substantially right angles to the locking portion 18 and the carrier 11. In other words, the terminal fitting piece 12 is connected with the carrier 11 while being laid on the left side in the orientation of FIG. 2 (see also FIG. 1), and the carrier 11 and the left side plate 14 are substantially flush with each other. Accordingly, the projections 17 preferably project in a direction substantially parallel to the longitudinal direction of the carrier 11 (preferably a direction substantially normal to the radial direction of the reel 20), and preferably are oriented in a substantially circumferential direction with the chained terminal 10 wound around the reel 20 (see FIG. 4).

A protecting portion 19 projects for each terminal fitting piece 12 on the same lateral edge of the carrier 11 as the terminal fitting piece 12. The protecting portion 19 substantially has an L-shape and fills a space left between the adjacent terminal fitting pieces 12 along the carrier 11. A projecting portion of the L-shaped protecting portion 19 is bent upwardly as the terminal fitting piece 12, and its leading end is bent toward the terminal fitting piece 12, thereby forming the L-shape. The height or projecting distance D of the protecting portion 19 from the carrier 11 is slightly larger than the height or projecting distance d of the terminal fitting piece 12 from the carrier 11 (see FIG. 4).

The terminal fitting pieces 12 are wound around the reel 20 with the interlayer sheet 21 laid along their radially inner surfaces. In their wound state, the interlayer sheet 21 is located at the outer side of each layer of the chained terminals 10. On the other hand, the projections 17 project outwardly from the terminal fitting pieces 12. The projecting direction thereof is not a radially outward direction of the reel 20 (direction toward the interlayer sheet 21) as in the prior art, but rather in a direction normal to the radial direction of the reel 20, i.e. a direction along the plane of the interlayer sheet 21. Therefore, there is no likelihood that the projections stick into the interlayer sheet 21 laid on its radially outer side.

Further, the protecting portions 19 formed on the carrier 11 project radially outward by a distance D substantially longer than the radially outward projecting distance d of the terminal fitting pieces 12 from the carrier 11. Accordingly, the protecting portions 19 are held in contact with the interlayer sheet 21 on the radially outer side. This enables intervals between the respective layers of the chained terminals 10 to be larger than the radially outward projecting distance of the terminal fitting pieces 12, thereby preventing the terminal fitting pieces 12 from contacting the interlayer sheet 21 laid on the radially outer side.

When the chained terminals 10 are dispensed from the reel 20, they are dispensed together with the interlayer sheet 21 laid along the inner surfaces thereof. Accordingly, the interlayer sheet 21 of the terminal fitting pieces 12 being dispensed departs from the terminal fitting pieces 12 adjacent thereto at the radially inner side. If the projections 17 of the terminal fitting pieces 12 on the radially inner side should be in contact with the interlayer sheet 21 being dispensed, they might stick into the interlayer sheet 21 and might be deformed by being caught in the interlayer sheet 21 being dispensed. However, in this embodiment, the projections 17 project substantially in the direction along or substantially parallel to the plane of the interlayer sheet 21 (preferably a substantially circumferential direction of the reel 20), and the protecting portions 19 ensure a sufficient space between the interlayer sheet 21 on the radially inner side and that on the radially outer side. Such a construction prevents the inwardly located projections 17 from sticking into the interlayer sheet 21 and the projections 17 and the interlayer sheet 21 from coming into contact with each other. This securely prevents the interlayer sheet 21 being dispensed from catching and deforming the projections 17 as the chained terminals 10 and interlayer sheet are dispensed.

The present invention is not limited to the described and illustrated embodiment but, for example, the following embodiments are also embraced by the technical scope of the present invention as defined in the claims. Besides the following embodiments, a variety of other changes can be made without departing from the scope and spirit of the invention as defined in the claims.

Although the terminal fittings to be connected to the printed circuit boards are described in the foregoing embodiment, the present invention is also applicable to terminal fittings which have projections, but are not designed to be connected to printed circuit boards.

Although the carrier is formed with the protecting portions in the foregoing embodiment, no protecting portions may be formed according to the invention.

In the foregoing embodiment, the interlayer sheet is laid along the radially inner surfaces of the chained terminals when they are wound around and dispensed from the reel. However, the interlayer sheet may be laid on the radially outer side of the chained terminals according to the invention.

Although the projections of the terminal fitting pieces project in the same direction as the carrier extends in the foregoing embodiment, they may project in a direction normal to or oblique to the extension of the carrier.

What is claimed is:

1. Chained terminals having an elongate substantially planar carrier defining a direction of elongation, and being sufficiently flexible for winding onto a reel, a plurality of terminal fitting pieces extending from a lateral edge of the carrier, the terminal fitting pieces being formed with connection projections projecting therefrom for electronically connecting the terminal fitting pieces to an external device, the terminal fitting pieces being connected with the carrier such that the connection projections thereof project in directions substantially parallel to the direction of elongation of the elongate carrier, and such that the connection portions are offset from the plane of the carrier by a first selected distance, a substantially L-shaped protecting portion projecting from the carrier, the protecting portion having a first leg aligned substantially orthogonal to the carrier and a second leg cantilevered from the first leg and extending in a direction substantially parallel to the direction of elongation of the carrier, the second leg of the protecting portion being offset from the plane of the carrier by a second selected distance, the second selected distance being greater than the first selected distance.

2. Chained terminals according to claim 1, wherein the chained terminals are wound around and dispensable from a reel, an interlayer sheet being laid between adjacent layers of the chained terminals, the terminal fitting pieces being connected with the carrier such that the connection projections thereof and the second leg of each L-shaped protecting portion project substantially normal to radial directions of the reel.

3. Chained terminals according to claim 2, wherein the second legs of the respective protecting portions engage the interlayer sheet when the chained terminals are dispensed from the reel, and the second legs of the L-shaped protecting portions coming into contact with the interlayer sheet when the chained terminals are wound around the reel, and thereby keeping the interlayer sheet and the terminal fitting pieces substantially separated from each other.

4. Chained terminals according to claim 1, wherein the terminal fitting piece is connected to the carrier via a covering portion configured and disposed to substantially cover an opening of the terminal fitting piece after its separation from the carrier.

5. Chained terminals according to claim 1, wherein the connection projections of each said terminal fitting piece and the second leg of the corresponding protecting portion are at overlapping positions along the elongate carrier such that the protecting portions effectively protect the connection portions of the respective terminal fitting pieces.

6. A method for forming chained terminals comprising:

stamping a metal plate for forming an elongate carrier defining a direction of elongation and a plurality of planar terminal fitting pieces projecting from a lateral side of the elongate carrier;

bending the terminal fitting pieces; and providing the carrier with L-shaped protecting portions, each said protecting portion having a first leg projecting in a direction substantially normal to the carrier and a second leg aligned substantially parallel to the direction of elongation of the carrier, a projecting distance of the first legs of the respective protecting portions in a direction normal to the plane of the carrier being larger than a projecting distance of an adjacent one the terminal fitting pieces.

7. A method according to claim 6, further comprising the step of winding the chained terminals around a reel with an interlayer sheet laid between adjacent layers of the chained terminals, wherein the bending is carried out such that the terminal fitting pieces are bent from the carrier such that connection projections of the terminal fitting pieces project in directions substantially normal to radial directions of the reel.

* * * * *